United States Patent [19]

Chachin et al.

[11] 4,068,514

[45] Jan. 17, 1978

[54] DEVICE FOR ELECTROHYDRAULIC DIE-FORGING

[76] Inventors: Viktor Nikolaevich Chachin, bulvar Lunacharskogo, 8, kv. 21; Jury Efimovich Sharin, ulitsa Ya. Kolasa, 43, korpus 1, kv. 18; Gennady Nikolaevich Zdor, ulitsa V. Khoruzhei, 19, kv. 14; Vladimir Leontievich Shaduya, ulitsa Pervomaiskaya, 8, kv. 7; Alexandr Julyanovich Zhuravsky, prospekt Partizansky, 28, korpus 2, kv. 135, all of Minsk, U.S.S.R.

[21] Appl. No.: 704,178

[22] Filed: July 12, 1976

[51] Int. Cl.[2] ..... B21D 26/02

[52] U.S. Cl. ..... 72/56; 72/454; 74/89.15

[58] Field of Search ..... 72/56, 454, 449; 74/89.15, 424.8 R

[56] References Cited

U.S. PATENT DOCUMENTS

| | | | |
|---|---|---|---|
| 3,491,564 | 1/1970 | Hundley et al. | 72/56 |
| 3,803,927 | 4/1974 | Lawler | 74/89.15 |
| 3,842,652 | 10/1974 | Yonezawa et al. | 72/454 |

*Primary Examiner*—Leon Gilden

*Attorney, Agent, or Firm*—Lackenbach, Lilling & Siegel

[57] ABSTRACT

A device for electrohydraulic die-forging comprises an explosion chamber and a die with a blank pressed against said chamber in the course of die-forging. The mechanism for moving the die plate and pressing the die against the explosion chamber is formed by a kinematic screw-and-nut pair. The progressively moving element of said pair is rigidly connected to the die plate, whereas the rotatable element of said pair is kinematically linked with a drive for moving said die plate. The rotatable element is also linked kinematically with an independent drive for pressing the die against the explosion chamber when the die plate drive is disconnected.

3 Claims, 3 Drawing Figures

DEVICE FOR ELECTROHYDRAULIC DIE-FORGING

The present invention relates to high-speed pressure-working of metals and more particularly it relates to devices for electrohydraulic die-forging.

The device of the present invention can be utilized in machine-building, instrument-building, aircraft-building and other industries.

The present invention can be used to advantage in making parts of a complex shape from sheet and tubular blanks of hard-to-work materials.

In the prior art is a device for electrohydraulic die-forging comprising a bed which supports two parallel columns a plate mounting an explosion chamber is rigidly secured to the columns. One electrode is located inside the chamber whose wall serves as the other electrode. The explosion chamber is filled with a service fluid which is capable of conveying the energy of explosion to the blank.

Installed parallel to the rigidly-secured plate is a movable plate which carries the blank-holding die.

The movable plate is arranged between the colums which serve simultaneously as guides and is connected with a mechanism intended to move said plate and press the die against the explosion chamber.

Said mechanism in the known device for electrohyraulic die-forging consists of two wedge elements. One of the wedge elements is fastened rigidly to the movable die-plate while the other is connected with a drive intended to reciprocate it over the base plate of the bed, and said base plate being set parallel to the movable plate.

The wedge elements are in constant contact which each other over their surfaces which are inclined towards the parallel-mounted plates.

During the reciprocating motion of one wedge element, the other wedge element moves the movable die plate towards and away from the explosion chamber, and said movable plate being rigidly connected with said other wedge element.

As a result, the die is moved towards the explosion chamber and pressed against it.

A disadvantage of the known device for electrohydraulic die-forging resides in that the drive of the mechanism for moving the die and pressing it against the explosion chamber can be a hydraulic, pneumatic, mechanical or electromechanical system which is rather complicated and calls for skilled attendance.

Another disadvantage of the known device with this form of the mechanism for moving the die and pressing it against the explosion chamber resides in that the travel of the die towards the explosion chamber cannot be considerably increased when the device is refitted for manufacturing different parts. Replacement of the die involve the use of additional plates placed between the movable plate and the die which complicates the design of the entire device and makes its operation difficult. Besides, this extends the time required for replacing the die.

The main object of the invention resides in providing a device for electrohydraulic die-forging wherein the mechanism for moving the die and pressing it against the explosion chamber is more reliable in service and simple in operation.

This object is accomplished by providing a device for electrohydraulic die-forging wherein a bed mounts at least two parallel columns supporting a rigidly secured plate with an explosion chamber and serving as guides for a movable die plate which is installed parallel to the rigidly secured plate with a provision for reciprocating towards and away from it along the columns for moving the die and pressing it against the explosion chamber in the course of die-forging. The die plate is moved and pressed against the explosion chamber in the course of die-forging by means of a mechanism made in the form of a kinematic screw-and-nut pair whose progressively-moving element is rigidly secured to the die plate while its rotatable element is mounted on the bed and kinematically linked with a drive for moving the die plate and with an independent drive for pressing the die against the explosion chamber when the drive for the moving the die plate is disconnected.

Such a layout of the mechanism is sufficiently simple and ensures tight pressing of the die with the blank against the explosion chamber in the course of die-forging.

The kinematic linkage of the rotatable element of the kinematic screw-and-nut pair with the independent drive for pressing the die against the explosion chamber comprises two ratchet wheels rigidly secured to the rotatable element and arranged one above the other, each of said wheels being connected by a pawl with its independent drive for turning the rotatable element in one direction to press the die against the explosion chamber and in the other direction to withdraw the die on completion of die-forging.

This kinematic linkage between the rotatable element of the kinematic screw-and-nut pair and the independent drive for pressing the die against the explosion chamber enables the device to move the die plate and press it with the aid of one and the same kinematic screw-and-nut pair which simplifies considerably the servicing of the mechanism for moving the die with the blank and pressing it against the explosion chamber.

It should also be noted that the kinematic linkage of the rotatable element of the kinematic screw-and-nut pair with the drive for moving the die plate comprises a jaw coupling whose jaws are set with a clearance between their side surfaces thus ensuring the possibility for turning the ratchet wheels.

Such a coupling for disconnecting the kinematic chain between the rotatable element and the drive for moving the die plate is sufficiently simple and reliable.

The device for electrohydraulic die-forging according to the present invention is reliable and simple in operation.

Replacement of the die in this device for making the parts of different shapes does not call for the introduction of additional elements so that refitting of this device is also simpler than that of prior known devices.

The device for electrohydraulic die-forging according to the invention is capable of manufacturing parts of a complex shape with a sufficiently high quality from hard-to-work materials.

Now the invention will be described in detail by way of example with reference to the accompanying drawings in which.

Figure 1:
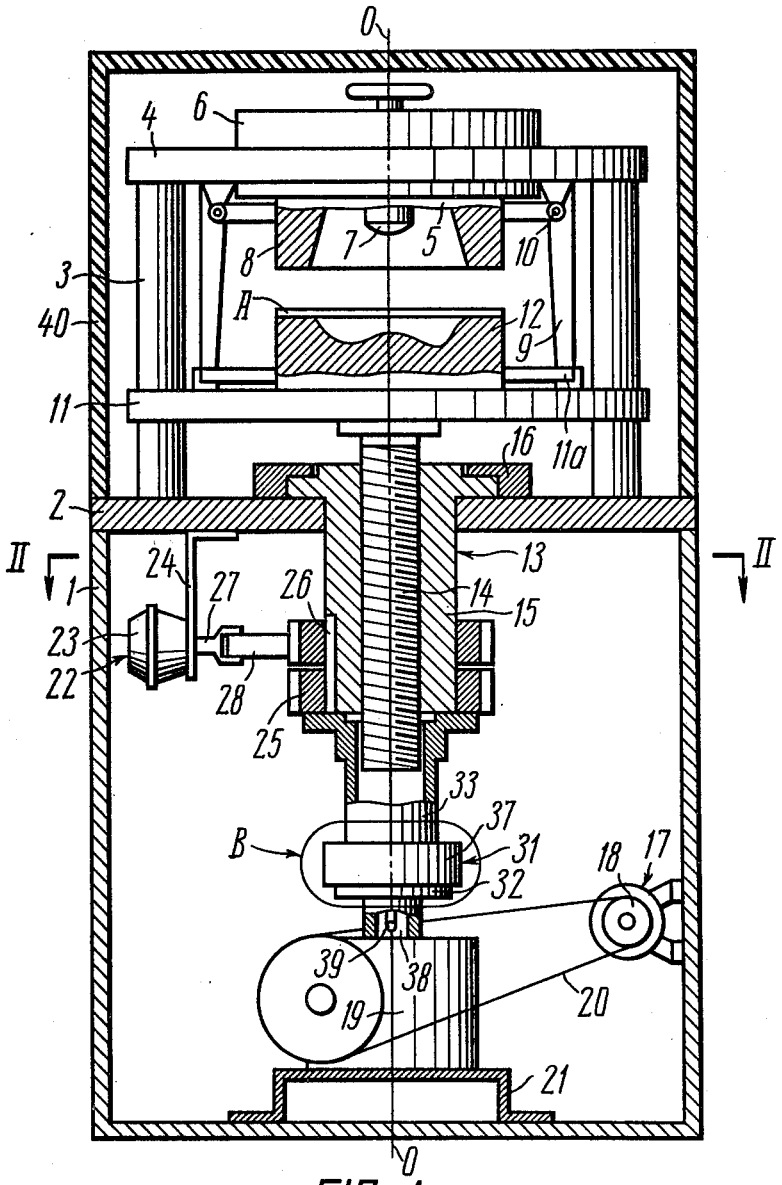
FIG. 1 is a schematic partial longitudinal section of the device for electrohydraulic die-forging according to the invention.

The device for electrohydraulic die-forging comprises a bed 1 (FIG. 1) which is suitably a welded box-shaped structure with a base plate 2 secured to it.

The first base plate 2 mounts has mounted thereon two columns 3 which carry a rigidly-secured first plate 4.

The plate 4 mounts supports an explosion chamber 5 and a discharge device 6 intended for switching powerful currents. The discharge device 6 is not dealt with here in detail so as not to obscure the essence of the invention as such discharge device may be of any known design suitable for this purpose.

Located inside the explosion chamber 5 along its geometric axis 0 — 0 is a first electrode 7 and the function of the other electrode 8 is fulfilled by the wall of the explosion chamber 5.

In the process of electrohydraulic die-forging the internal space of the explosion chamber 5 is filled with a service fluid, such as water, which conveys the energy of the discharge taking place between the electrodes 7 and 8 during die-forging.

A shutter 9 of an elastic material prevents splashing of water in the course of electrohydraulic die-forging. The shutter 9 can move over a circular guide 10 so as to close and open the space where water is likely to be splashing.

The device comprises another or second plate 11 with a water-collecting shell 11*a* secured to it.

The second plate 11 is set parallel to the rigidly-secured plate 4 with a provision for moving towards and away from it along the columns 3. The plate 11 carries a die 12 holding the blank A. The plate 11 with the blank 12 is moved and pressed against the explosion chamber 5 in the course of electrohydraulic die-forging by a mechanism 13 in the form of a kinematic screw-and-nut pair.

The progressively-moving element 14 of this pair is a screw 14 arranged along the axis 0 — 0 of the device for electrohydraulic die-forging.

The screw 14 is rigidly connected with the plate 11 carrying the die 12.

The rotatable element of the kinematic pair in the given embodiment of the invention is suitably a nut 15 which receives the screw 14.

The nut 15 is installed on the base plate 2 of the bed 1 with a provision for rotating relative to it and is held against axial movement relative to the same plate by a hold-down ring 16 rigidly secured to the base plate 2.

The nut 15 is kinematically linked with a drive 17 for moving the plate 11 with the die 12. The drive 17 consists of an electric motor 18 rigidly mounted on the bed 1 and a speed reducer 19 connected with the motor by a V-belt transmission 20. The speed reducer 19 is installed on a support 21 fastened to the bed 1.

The support 21 has slots (not shown in the drawing) arranged perpendicularly to each other. These slots permit the speed reducer 19 to be accurately aligned by moving it along the axis 0 — 0 of the device for electrohydraulic die-forging.

The nut 15 is kinematically linked with an independent drive 22 (FIGS. 1 and 2) for pressing the die 12 to and away from the explosion chamber 5.

The die 12 can be pressed and forced off by a single independent drive; however, in this embodiment of the invention there are preferably two independent drives 22, each consisting of a pneumatic chamber 23 of any design suitable for the given purpose.

Such a pneumatic chamber 23 is mounted with the aid of brackets 24 on the base plate 2 of the bed 1.

The kinematic linkage of the nut 15 with each independent drive 22 comprises two ratchet wheels 25 arranged one above the other and secured rigidly on the nut 15 with a key 26.

Each ratchet wheel 25 is connected with the corresponding pneumatic chamber 23 by a rod 27 (FIG. 2) which is, in turn, connected with a pawl 28 for moving it in a guide 29 and engaging the teeth 30 (FIGS. 1 and 2) of the ratchet wheel 25.

Figure 3:
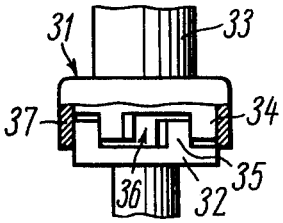
FIG. 3 is a fragmentary view of element B in FIG. 1 partially broken away for convenience of illustration.

One of the ratchet wheels 25 actuated by the corresponding independent drive 22 can turn the nut 15 in one direction for pressing the die 12 against the explosion chamber 5 whereas the other ratchet wheel 25 turns it in the other direction for withdrawing the die on completion of die-forging. This is accomplished with the drive 17 of the die plate 11 disconnected with the aid of a jaw coupling 31 (FIGS. 1, 3) included into the kinematic linkage of the nut 15 with the drive 17. The jaw coupling 31 consists of two coupling members 32 and 33 whose jaws 34 and 35 (FIG. 3) are set with a clearance 36 between their side surfaces thus enabling the ratchet wheels 25 to turn.

An aligning ring 37 (FIGS. 1, 3) installed at the joint between the coupling members 32 and 33 allows said members to be accurately set along the axis 0 — 0 of the device for electrohydraulic die-forging.

The coupling member 32 is secured on the shaft 38 (FIG. 1) of the speed reducer 19 by a key 39 while the coupling member 33 is rigidly fastened to one of the ratchet wheels 25.

The base plate 2 of the bed 1 also supports a guard housing 40 which shields or closes the device off during electrohydraulic die-forging.

The device for electrohydraulic die-forging functions as follows. Before the beginning of the die-forging process the plate 11 carrying the die 12 is set in such a position as to form a space between the die 12 and the explosion chamber 5 allowing the blank A (FIG. 1) to be installed on the die 12.

An operator places the blank A on the die 12 and turns on the drive 17 for actuating the mechanism 13 moving the plate 11.

The plate 11 is moved progressively by the screw 14 turned into the nut 15. The nut 15 rotates relative to the base plate 2 of the bed 1 and is held against progressive motion relative to the same plate by the hold-down ring 16.

The nut 15 is rotated by the electric motor 18 via the speed reducer 19, V-belt transmission 20 and further via the jaw coupling 31 one member 33 of which is connected with the nut 15.

As the die 12 with the blank A comes in contact with the explosion chamber 5, the electric motor 18 stops and the nut 15 ceases to rotate.

Then the independent drive 22 (see top of FIG. 2) is turned on and the die 12 with the blank A is pressed against the explosion chamber 5 by one of the pneumatic chambers 23 actuated by an air system (not shown), the rod 27 of said chamber 23 acting on the pawl 28. The pawl 28 engages the corresponding ratchet wheel 25 and turns it. The turning ratchet wheel 25 causes additional rotation of the nut 15 which, in turn, moves the screw 14 progressively thus pressing the die 12 against the explosion chamber 5.

The ratchet wheel 25 is capable of turning due to the clearance 36 between the sides of the jaws 34 and 35 of the jaw coupling 31; said clearance permits free turning of the coupling member 33 connected with the nut 15.

After the die 12 with the blank A has been pressed against the explosion chamber 5, the rod 27 of the pneumatic chamber 23 comes back to the initial position thereby disengaging the pawl 38 from the ratchet wheel 25. This permits nut 15 to rotate in the opposite direction. The pneumatic chamber 23 is returned to the initial position by a spring (not shown in the drawing).

Then the explosion chamber 5 is filled with water and simultaneously the air is sucked out of the space of the die 12 in order not to interfere with die-forging; this improves the quality of th die-forged article.

Before the electric discharge the zone of the explosion chamber 5 and the die 12 with the blank A is closed by the shutter 9 which is moved along the circular guide 10. The shutter protects the operator and the walls of the guard housing 40 against water splashes formed by the electric discharge. Any water splashed on the shutter 9 drips down into the shell 11*a*.

Then an electric discharge between the electrodes 7 and 8 creates impact waves in water, and said waves shaping the blank A.

Figure 2:
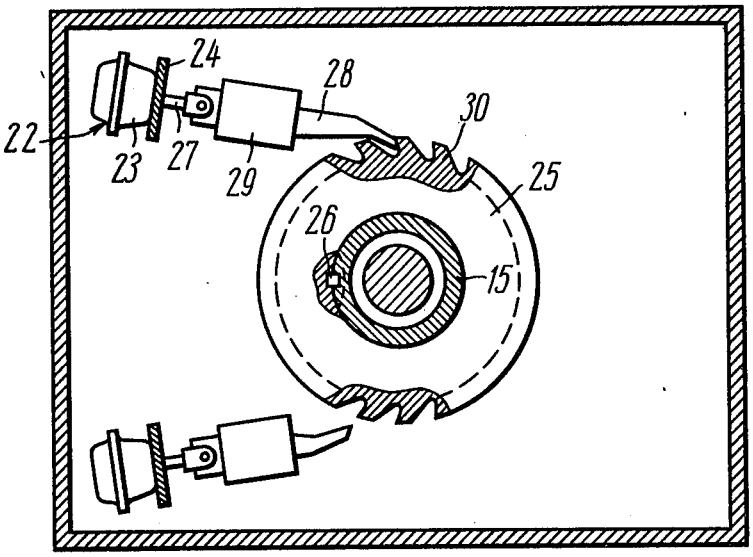
FIG. 2 is a sectional view, taken along the line II — II in FIG. 1.

The die 12 with the forged part is thereafter withdrawn by another independent drive 22 shown in the bottom of FIG. 2 if two drives are desired. The pneumatic chamber 23 of the independent drive 22 acts by its rod 27 on the pawl 28 and the latter engages the corresponding ratchet wheel 25.

The ratchet wheel 25 turns the nut 15 which, in its turn, moves the screw 14 down. After the withdrawal of the die 12 with the part the pawl 28 is disengaged from the ratchet wheel 25 by a spring (not shown) installed inside the pneumatic chamber 23.

The water flows out of the explosion chamber 5 into the shell 11*a* through the gap formed between the withdrawn die 12 with the forged part and the explosion chamber 5.

Sliding over the circular guide 10, the shutter 9 opens and the plate 11 carrying the die 12 with the forged part goes down enough to form a space between the explosion chamber 5 and the die 12 for extracting the finished part from the die 12.

After removing the finished part, the space of the die 12 is cleaned and dried after which the device is again ready for the next die-forging cycle.

An experimental device for electrohydraulic die-forging according to the present invention has passed all-round tests whose results gave proof of its high efficiency.

The device for electrohydraulic die-forging according to the invention is simple in operation and less expensive than the known devices.

The parts produced by this device feature a sufficiently high quality.

The device according to the invention is adapted for making parts of a complex shape from hard-to-work materials with a sufficiently high quality.

What is claimed is:

1. A device, for electrohydraulic die-forging of a blank, having a bed and at least two parallel columns secured on said bed; said device comprising a first plate rigidly secured on said columns; an explosion chamber located on said plate and adapted to contain a fluid; a power source; an electrode arranged in said explosion chamber and connected electrically to said power source; a wall of said explosion chamber serving as a second grounded electrode; a die supporting said blank mounted on another or second plate set parallel to said first plate and adapted to move towards and away from said first plate along said columns for moving said die and blank and pressing same against said explosion chamber in the course of die-forging; a mechanism for moving said second plate and pressing it against said explosion chamber being in the form of a kinematic screw-and-nut pair; said mechanism comprising a progressively moving element rigidly connected with said second plate; a rotatable element mounted on said bed; a drive system for progressively moving said second plate; and independent drive of said mechanism for pressing said die and blank against said explosion chamber; and said rotatable element being linked kinematically with said drive system of said second plate and with said independent drive for pressing said die and blank against said explosion chamber, whereby said die and blank are brought into contact with the explosion chamber and pressed thereagainst by the action of said drive system and said independent drive.

2. A device according to claim 1, wherein the kinematic linkage of said rotatable element comprises two independent drives, one for pressing said die and blank against said explosion chamber and the other four withdrawing the die and blank therefrom, said linkage including ratchet wheels rigidly secured on said rotatable element and arranged one above the other, each of said wheels being connected by a pawl with an independent drive of its own for turning said rotatable element in one direction for passing said die and blank against said explosion chamber, and in the other direction for withdrawing said die and blank on completion of the die-forging of said blank.

3. A device according to claim 2, wherein the kinematic linkage of the rotatable element with said drive system for progresively moving the second plate comprises a jaw coupling whose jaws are set with a clearance between their side surfaces which enables the ratchet wheels to be turned upon rotation of said jaw coupling by motor means forming part of said drive system.

* * * * *